US012180023B2

(12) United States Patent
Rutherford et al.

(10) Patent No.: US 12,180,023 B2
(45) Date of Patent: Dec. 31, 2024

(54) CORRUGATING ROLLERS APPARATUS AND METHOD FOR A MEDIA STORAGE BIN IN A SELF-SERVICE TERMINAL

(71) Applicant: NCR Corporation, Atlanta, GA (US)

(72) Inventors: Craig Rutherford, Blairgowrie (GB); Neil Law, Dundee (GB)

(73) Assignee: NCR Corporation, Atlanta, GA (US)

( * ) Notice: Subject to any disclaimer, the term of this patent is extended or adjusted under 35 U.S.C. 154(b) by 187 days.

(21) Appl. No.: 17/890,616

(22) Filed: Aug. 18, 2022

(65) Prior Publication Data

US 2024/0059514 A1 Feb. 22, 2024

(51) Int. Cl.
*B65H 29/70* (2006.01)
*B65H 5/06* (2006.01)
*B65H 29/20* (2006.01)

(52) U.S. Cl.
CPC ..... *B65H 29/70* (2013.01); *B65H 5/068* (2013.01); *B65H 29/20* (2013.01);
(Continued)

(58) Field of Classification Search
CPC ..... B65H 29/20; B65H 29/22; B65H 29/70; B65H 2301/5121; B65H 2301/5122; B65H 2401/11; B65H 2401/111; B65H 2404/1311; B65H 2404/1312; B65H 2404/1313; B65H 2404/1314;
(Continued)

(56) References Cited

U.S. PATENT DOCUMENTS 5,154,410 A * 10/1992 Baader ..... B31F 1/10 493/399
5,199,700 A * 4/1993 Fairey ..... B65H 29/70 271/220
(Continued)

FOREIGN PATENT DOCUMENTS

CN 110910562 A1 3/2020
EP 0038918 A2 * 11/1981 ..... B65H 29/14
(Continued)

OTHER PUBLICATIONS

European Written Opinion and Search Report for corresponding EP 4325454 dated Aug. 22, 2023.

*Primary Examiner* — Prasad V Gokhale
(74) *Attorney, Agent, or Firm* — Notaro, Michalos & Zaccaria P.C.; John S. Economou

(57) ABSTRACT

A self-service terminal, apparatus, and method for corrugating received media items is disclosed. A bin is provided for storing media items. A pathway selectively conveys a received media item to the bin. An apparatus that include as set of paired corrugating drive rollers is mounted in the pathway for creasing the received media item as it is conveyed to the bin. The set of paired corrugating drive rollers has a plurality of first corrugating rollers mounted in a spaced apart fashion on a common shaft, each of the first corrugating rollers having an outwardly facing rounded-V profile, and a plurality of second corrugating rollers mounted in a spaced apart fashion on a common shaft, each of the second corrugating rollers having an inwardly facing slot. Each of the plurality of first corrugating rollers is positioned adjacent to a corresponding one of the plurality of second corrugating rollers.

17 Claims, 4 Drawing Sheets

(52) U.S. Cl.
CPC ..... *B65H 2301/44324* (2013.01); *B65H 2301/5122* (2013.01); *B65H 2404/532* (2013.01)

(58) Field of Classification Search
CPC .... B65H 2404/1315; B65H 2404/1316; B65H 2404/13161; B65H 2404/1371; B65H 2404/1415; B65H 2404/532; B65H 2515/81; G07D 11/16; G07D 11/175
See application file for complete search history.

(56) References Cited

U.S. PATENT DOCUMENTS

| | | | | |
|---|---|---|---|---|
| 5,582,361 | A * | 12/1996 | Muller | B65H 27/00 242/542.4 |
| 5,683,079 | A | 11/1997 | Ebrahimi | |
| 2006/0163803 | A1* | 7/2006 | Izuchi | B65H 29/70 271/272 |
| 2007/0290428 | A1* | 12/2007 | Schererz | B65H 31/06 271/1 |
| 2014/0203498 | A1 | 7/2014 | Law et al. | |
| 2017/0001825 | A1* | 1/2017 | Baek | B65H 29/14 |
| 2019/0051081 | A1 | 2/2019 | Liang et al. | |
| 2021/0094780 | A1 | 4/2021 | Rutherford | |
| 2022/0162031 | A1 | 5/2022 | Rutherford | |

FOREIGN PATENT DOCUMENTS

| | | | |
|---|---|---|---|
| EP | 3 366 622 | A2 | 8/2018 |
| WO | 2016184340 | A1 | 11/2016 |

* cited by examiner

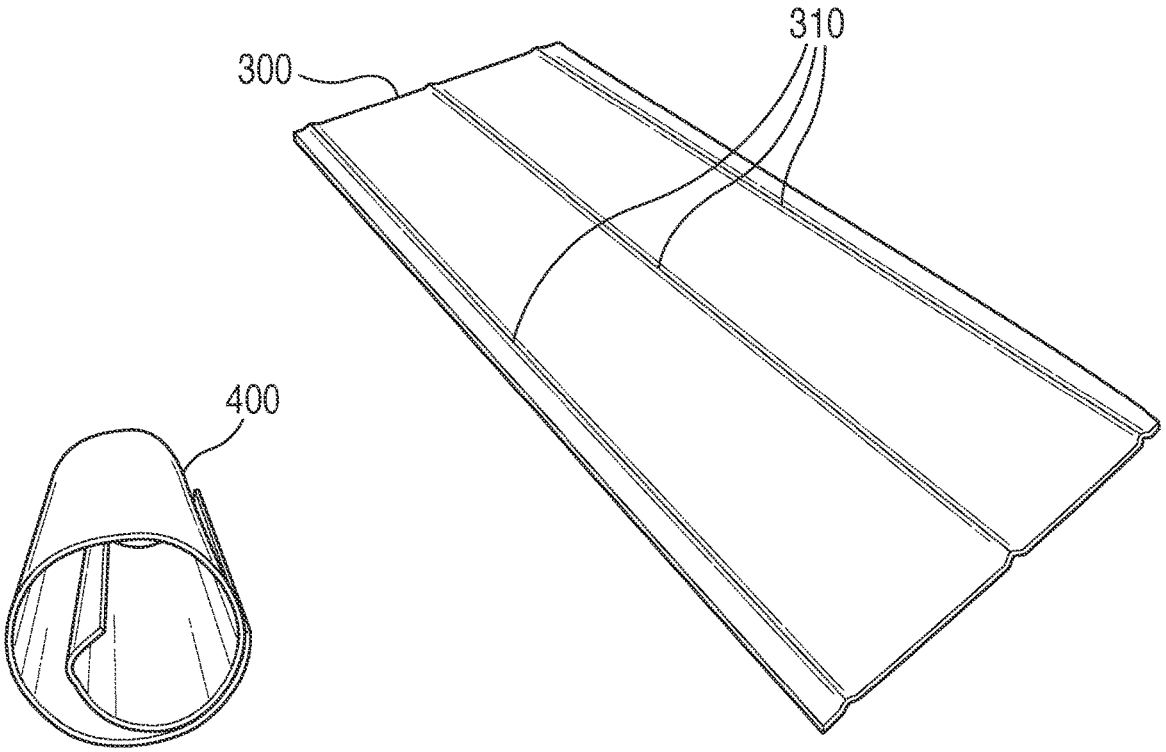
FIG. 3
FIG. 4A
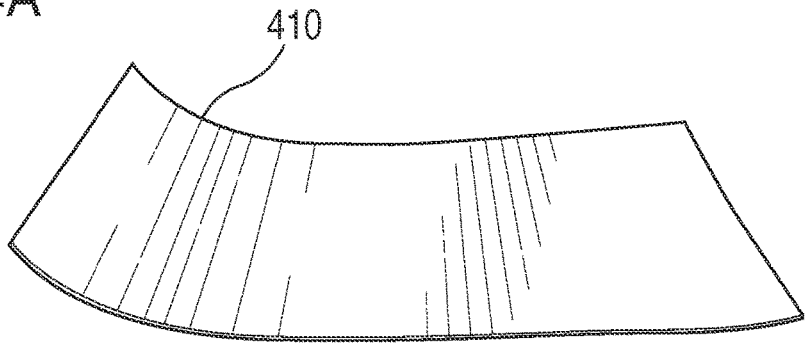
FIG. 4B
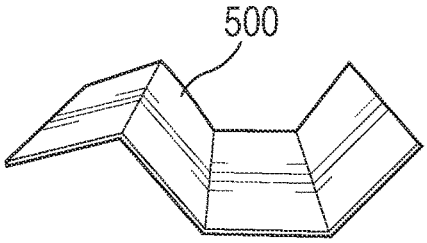
FIG. 5A
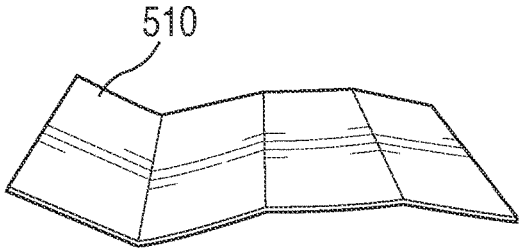
FIG. 5B

CORRUGATING ROLLERS APPARATUS AND METHOD FOR A MEDIA STORAGE BIN IN A SELF-SERVICE TERMINAL

FIELD

This disclosure relates generally to corrugating rollers for a media storage bin in a self-service terminal, and more particularly to corrugating rollers that crease (corrugate) input media items being fed to the media storage bin in order to prevent input jams and prematurely-filled bins resulting from deformed media items.

BACKGROUND

Self-service terminals, such as automatic teller machines, may include one or more bins for receiving media items. These media items may include, for example, checks or cash (banknotes) for deposit. When the deposited media items are in good condition and in uniform size, the media items stack neatly in the bin and allow the full bin capacity to be consistently reached. However, when the deposited media items are not in good condition, i.e., worn or with heavy creases or folds, the media items can deform, e.g., folding or curling in a manner that would require more horizontal space than a non-deformed media item, upon insertion into the bin and stacked onto a previously inserted media item. This causes the deformed media item (or items) to take up too much bin volume and significantly reduces the capacity of the bin—requiring, inter alia, more frequent service visits to empty the bin. Deformed media items can also cause a jam at an input of the bin which can put the self-service terminal out of service and require an immediate service visit to clear the jam. Similarly, when media items are not of uniform size, the trailing edge of a shorter item (lengthwise) can catch the leading edge of the next inserted item and cause one or both of the media items to deform and take up too much room within the bin, again resulting in more frequent service visits to empty the bin.

Accordingly, there is a need for a media storage bin for a self-service terminal which addresses the drawbacks recited above.

BRIEF DESCRIPTION OF THE DRAWINGS

The following detailed description, given by way of example and not intended to limit the present disclosure solely thereto, will best be understood in conjunction with the accompanying drawings in which:

FIG. 3 is a view of a check showing the creases (corrugations) formed after being passed through the corrugating rollers in accordance with present disclosure;

FIG. 4A is a view of a first deformed check prior to passing through the corrugating rollers in accordance with present disclosure, and FIG. 4B is a view of that first deformed check after being passed through the corrugating rollers in accordance with present disclosure;

FIG. 5A is a view of a second deformed check prior to passing through the corrugating rollers in accordance with present disclosure, and FIG. 5B is a view of that second deformed check after being passed through the corrugating rollers in accordance with present disclosure;

DETAILED DESCRIPTION

In the present disclosure, like reference numbers refer to like elements throughout the drawings, which illustrate various exemplary embodiments of the present disclosure.

The present disclosure describes a short edge storage bin with media corrugating drive rollers for accepting unsorted lengths and condition of media items such as bank checks and banknotes which overcomes the problems with conventional short edge storage bins. One way to reduce the chance of curled or folded media items causing problems is to flatten them as much as possible while conveying them into the storage bin. A set of corrugating male and female rollers, as described below, placed in the conveyance path into the storage bin, causes the shape of these media items to change by introducing small permanent grooved ridges (corrugations) along the length thereof. The formed grooved ridges greatly minimize the effect of any deformities in the media item and thus reduce the possibility of jams, etc. The formed grooved ridges in the media items also increase the stiffness thereof significantly. This added stiffness enables the leading edge of an incoming check to push over or under any obstacle (e.g., a shorter check previously inserted into the bin) without folding and buckling. As a result, this added stiffness significantly reduces the presence of curled or folded media items within the bin caused by different lengths of media items, ensuring that the bin does not become prematurely filled and thus requiring less service calls than in the past. The addition of the corrugating rollers of the present disclosure will also substantially improve the neatness of media items stacked within the bin, which, in turn, increases the number of media items stored within the same volume of bin than in prior applications.

Figure 1:
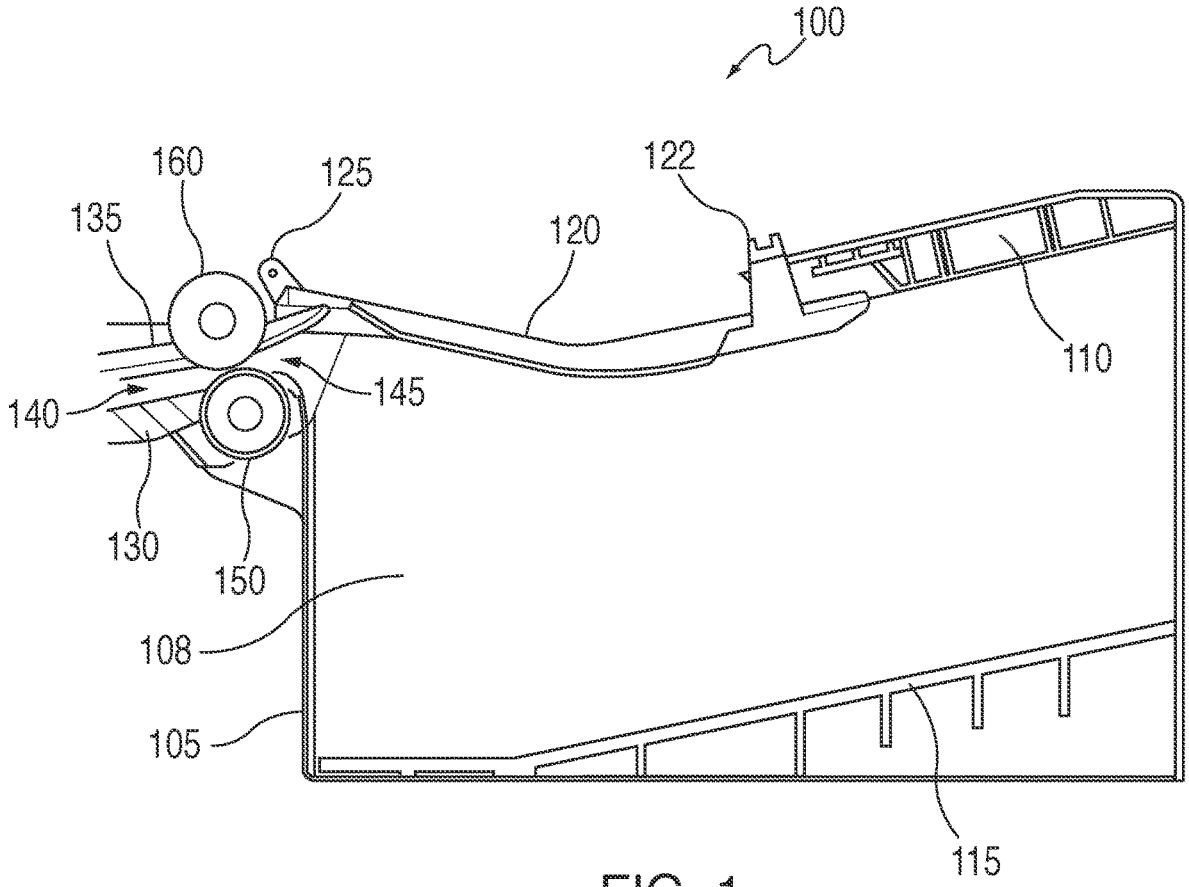
FIG. 1 is a side view of a media storage bin having corrugating rollers mounted at an input thereof in accordance with the present disclosure.

Referring now to FIG. 1, a media storage bin 100 for use with a self-service terminal is formed by an enclosure 105 that has an internal cavity 108. Media storage bin 100 receives media items (e.g., checks or banknotes) via a slot 145 after such items are deposited into the self-service terminal by a user. Media storage bin 100 has a guide member 120 for directing inserted media items downward onto a base plate 115. Guide member 120 includes a hinge 125 that is mounted at a first end to a structural member (not shown) mounted outside of enclosure 105 via apertures in a wall of the enclosure 105. Guide member 120 has a second free end extending at least partially across a width of enclosure 105. In an alternative embodiment, hinge 125 may be mounted inside enclosure 105 to a structural member extending from the wall of enclosure 105. In both embodiments, by mounting hinge 125 directly adjacent to the wall of the enclosure, guide member 120 freely rotates (pivots) around a central axis of hinge 125. The range of motion of guide member 120 is fixed upwardly by a fixed upper portion 110 of enclosure 105 and downwardly by upward extension 122 of guide member 120, which has an inward facing hook at a top portion thereof that catches on a top surface of the fixed upper portion to prevent further downward motion. A contact switch may be positioned between the guide member 120 and the fixed upper portion 110 that is used to signal when the internal cavity 108 of the enclosure 105 is filled with media items (i.e., when the enclosure 105 is filled with media items, the guide member 120 will become forced up against the lower surface of the fixed upper portion 110 and the contact switch will activate).

Figure 6:
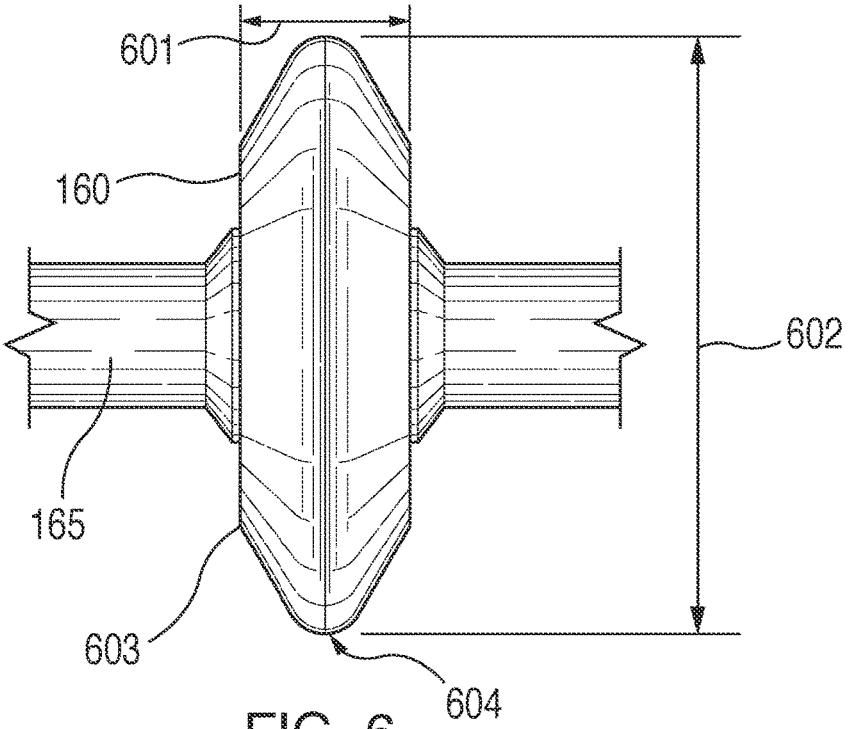
FIG. 6 is a view showing the features of each of the top corrugating rollers in accordance with present disclosure.
Figure 7:
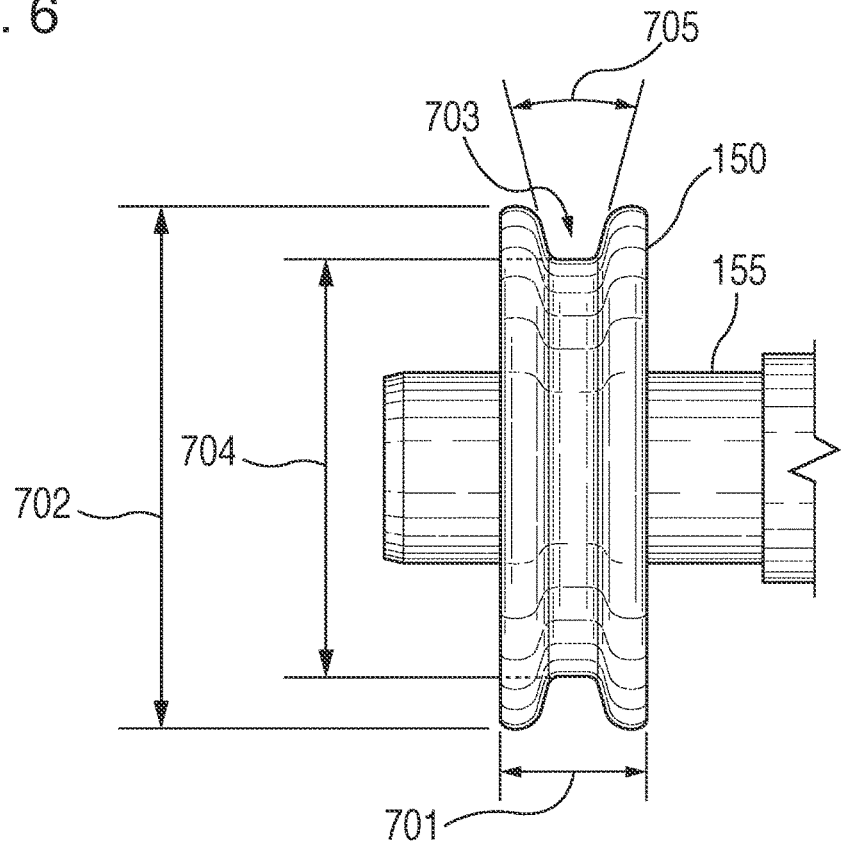
FIG. 7 is a view showing the features of each of the bottom corrugating rollers in accordance with present disclosure.

Media items are fed to the inner portion 108 of the enclosure 105 via a pathway 140 formed by an upper support 135 and a lower support 130. Pathway 140 may, for example, be fed from an external input of the self-service terminal in order for a user to deposit media items. First and second corrugating rollers 160, 150 are mounted along pathway 140, and preferably adjacent to the input slot 145, on respective shafts 165, 155. Each of the first corrugating rollers 160 has an outwardly-facing rounded V-shape profile while each of the second corrugating rollers 150 has an inwardly-facing slot-like profile. The particular structure of each of the first corrugating rollers 160 is shown in FIG. 6 and discussed below. The particular structure of each of the second corrugating rollers 150 is shown in FIG. 7 and discussed below. Although the upper and second corrugating rollers 160, 150 are shown mounted along pathway 140 directly adjacent to enclosure 105 in the embodiment shown in FIG. 1, in other embodiments the rollers may be positioned at any point along pathway 140, either alone as the only drive mechanism for conveying the media items to the enclosure 105 or in conjunction with other sets of drive mechanism (e.g., conventional paired drive rollers). In addition, all the first corrugating rollers 160 are shown in an upper position and the second corrugating rollers 150 are shown in a lower position in FIG. 2A, in other embodiments the positions may be reversed, either with respect to all pairs of rollers or on an individual paired basis.

Figure 2A:
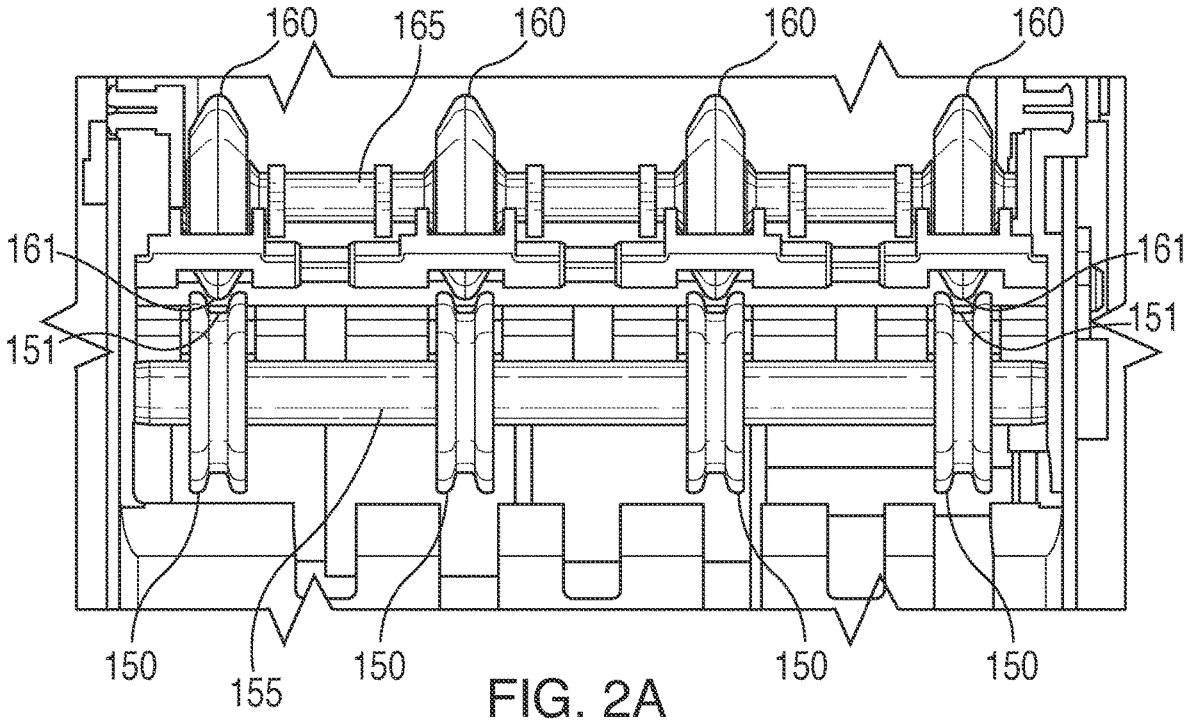
FIG. 2A is a view of the corrugating rollers in accordance with present disclosure from an internal point in the media storage bin of FIG. 1.
Figure 2B:
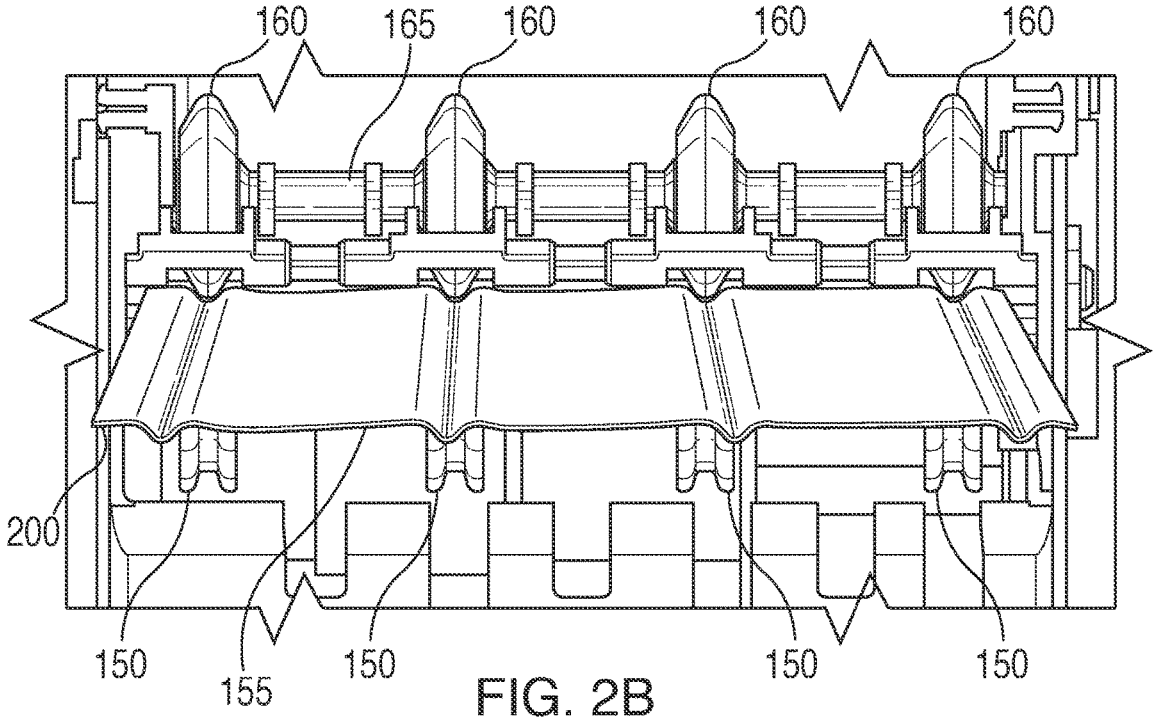
FIG. 2B is similar view showing a check passing through the corrugating rollers in accordance with present disclosure.

Referring now to FIG. 2A, a view of the corrugating rollers is provided from the inner portion 108 of the enclosure 105 which shows the first corrugating rollers 160 mounted on a first common shaft 165 and the second corrugating rollers 150 mounted on a second common shaft 155. The two shafts 165, 155 are driven by a mechanism not shown (e.g., a motor) in a known manner to push media items (checks or banknotes) along the pathway 140. In the embodiment shown in FIG. 2A, there are four of each type of roller (i.e., first corrugating rollers 160 and second corrugating rollers 150), but in other embodiments there may be a greater or less number of paired rollers, depending on the particular application. As shown in FIG. 2A, an outer tip 161 (outermost portion) of the outwardly-facing rounded V-shape of each first corrugating roller 160 is positioned so that it protrudes within an inwardly-facing slot 151 of the corresponding second corrugating roller 150 but preferably without the two paired rollers 160, 150 contacting each other. As shown in FIG. 2B, when a media item 200 passes through the rollers 160, 150, pressure will be applied to the media item which forms a longitudinal crease at each point of contact between each pair of first corrugating rollers 160 and second corrugating rollers 150 and the media item 200.

FIG. 3 is a diagram showing a media item (e.g., a check) 300 having three longitudinal creases 310 formed by passing the media item 300 through the paired corrugating rollers 160, 150. As evident and as shown in FIG. 2B, although there are four matched pairs of rollers, in some cases the width of the media item, as with media item 200 in FIG. 2B, may only span across a subset of the rollers (which is why there are only three creases 310 shown on the media item 300 in FIG. 3).

FIG. 4A is a diagram showing an example of a deformed media item (i.e., a check 400 curled up along its length) prior to being fed through the paired corrugating rollers 160, 150. FIG. 4B is a diagram showing a processed version 410 of the check 400 after passing through corrugating rollers 160, 150 demonstrating that much of the curling can be removed by adding creases (corrugations) to the check. For clarity, the creases added are not shown in FIG. 4B.

FIG. 5A is a diagram showing another example of a deformed media item (i.e., a folded check 500) prior to being fed through the paired corrugating rollers 160, 150. FIG. 5B is a diagram showing a processed version 510 of the check 500 after passing through corrugating rollers 160, 150 demonstrating that much of the deformities caused by folding can be removed by adding creases (corrugations) to the check. For clarity, the creases added are not shown in FIG. 5B.

The material used to form rollers 160, 150 must be balanced between obtaining good drive for each media item passing between such rollers and preventing damage to that media item. This balance is more important on the second corrugating roller 150 than the first corrugating roller 160 because the inwardly-facing slot in the second corrugating roller 150 must allow the media item to move a certain amount when pressed into the internal space thereof without tearing it. For that reason, the rollers 160, 150 are formed from a material having a hardness of about 80 shore, for example an 80 shore hardness thermoplastic elastomer (TPE) material or an 80 shore nitrile rubber (NBR) material.

FIG. 6 is a diagram showing in detail the features of the first corrugating roller 160 mounted on shaft 165. In a preferred embodiment, the first corrugating roller 160 has width 601 of about 7 mm and a diameter 602 of about 24.7 mm. The outwardly-facing rounded V-shape of the first corrugating roller 160 has an angle 603 of about 60 degrees, and a rounded tip 604 (outermost portion) having an outer radius of about R1.5 mm.

FIG. 7 is a diagram showing in detail the features of the second corrugating roller 150 mounted on shaft 155. In a preferred embodiment, the second corrugating roller 150 has a width 701 of about 7 mm and a diameter 702 of about 25 mm. The inwardly-facing slot 703 is formed with an inner diameter 704 of about 20 mm and with sidewalls having an angle 705 of about 28 degrees.

The geometry of first corrugating rollers 160 and second corrugating rollers 150 is chosen to provide a balance between the amount of corrugation (creasing) provided in the material (e.g., paper) forming the media items and the potential for damaging such media items. The outer radius (e.g., about R1.5 mm) of the rounded tip 604 (outermost portion) of each upper corrugating roller 160 and the amount of interference between each pair of first corrugating rollers 160 and second corrugating rollers 150 are important dimensions to be selected to ensure the appropriate balance. The amount of interference can be seen in FIG. 2A where the rounded tip 161 (outermost portion) of each first corrugating roller 160 is shown positioned with a gap formed by the inwardly-facing slot 151 of each corresponding second corrugating roller 150 but preferably without the two paired rollers 160, 150 contacting each other. This amount of interference ensures that each media item passing through the paired rollers 160, 150 will be creased (corrugated) to a certain degree but not ripped or otherwise damaged. This amount of corrugation helps to remove any deformations present in the media items and ensures that all the media items stack neatly within the enclosure 105 and that no jams form at the input 145 of enclosure 105. By neatly stacking the media items within enclosure 105 in this manner, the full capacity of enclosure 105 is used and premature service calls due to jams and prematurely-filled bins resulting from deformed media items are avoided.

Although the present disclosure has been particularly shown and described with reference to the preferred embodiments and various aspects thereof, it will be appreciated by those of ordinary skill in the art that various changes and modifications may be made without departing from the spirit and scope of the disclosure. It is intended that the appended claims be interpreted as including the embodiments described herein, the alternatives mentioned above, and all equivalents thereto.

What is claimed is:

1. A self-service terminal, comprising:

a bin for storing media items;

a pathway for conveying a received media item to the bin; and a set of paired corrugating drive rollers mounted in the pathway for creasing the received media item as it is conveyed to the bin; and wherein the set of paired corrugating drive rollers comprises a plurality of first corrugating rollers mounted in a spaced apart fashion on a common shaft, each of the first corrugating rollers having an outwardly facing rounded-V profile with an angle of about 60 degrees, each of the first corrugating rollers having a width of about 7 mm and a diameter of about 24.7 mm, and wherein a rounded tip of each of the first corrugating rollers has an outer radius of about R 1.5 mm.

2. The self-service terminal of claim 1, wherein the set of paired corrugating drive rollers comprises a plurality of second corrugating rollers mounted in a spaced apart fashion on a common shaft, each of the second corrugating rollers having an inwardly facing slot having an inner diameter of about 20 mm and sidewalls having an angle of about 28 degrees, wherein each of the second corrugating rollers has a width of about 7 mm and a diameter of about 25 mm.

3. The self-service terminal of claim 2, wherein an outermost portion of the outwardly facing rounded-V profile of each of the plurality of first corrugating rollers is positioned within the inwardly facing slot of the corresponding one of the plurality of second corrugating rollers.

4. The self-service terminal of claim 3, wherein each of the plurality of first corrugating rollers is formed from a material having a hardness of about 80 shore.

5. The self-service terminal of claim 4, wherein the material is nitrile rubber.

6. The self-service terminal of claim 3, wherein each of the plurality of second corrugating rollers is formed from a material having a hardness of about 80 shore.

7. The self-service terminal of claim 6, wherein the material is nitrile rubber.

8. The self-service terminal of claim 2, wherein an outermost portion of the outwardly facing rounded-V profile of each of the plurality of first corrugating rollers is positioned within the inwardly facing slot of the corresponding one of the plurality of second corrugating rollers without each of the plurality of first corrugating rollers contacting the corresponding one of the plurality of second corrugating rollers.

9. A method of corrugating a media item, comprising:

conveying a received media item to a bin for storing media items via a pathway; and providing the media item to a set of paired corrugating drive rollers mounted in the pathway for creasing the received media item as it is conveyed to the bin; wherein the set of paired corrugating drive rollers comprises:

a plurality of first corrugating rollers mounted in a spaced apart fashion on a common shaft, each of the first corrugating rollers having an outwardly facing rounded-V profile with an angle of about 60 degrees, each of the first corrugating rollers having a width of about 7 mm and a diameter of about 24.7 mm, and wherein a rounded tip of each of the first corrugating rollers has an outer radius of about R 1.5 mm.

10. An apparatus for corrugating a media item, comprising:

a set of paired corrugating drive rollers mounted in a pathway for conveying a received media item to a storage bin; wherein the set of paired corrugating drive rollers comprises:

a plurality of first corrugating rollers mounted in a spaced apart fashion on a common shaft, each of the first corrugating rollers having an outwardly facing rounded-V profile with an angle of about 60 degrees, each of the first corrugating rollers having a width of about 7 mm and a diameter of about 24.7 mm, and wherein a rounded tip of each of the first corrugating rollers has an outer radius of about R 1.5 mm.

11. The apparatus of claim 10, wherein the set of paired corrugating drive rollers comprises:

a plurality of second corrugating rollers mounted in a spaced apart fashion on a common shaft, each of the second corrugating rollers having an inwardly facing slot having an inner diameter of about 20 mm and sidewalls having an angle of about 28 degrees, wherein each of the second corrugating rollers has a width of about 7 mm and a diameter of about 25 mm.

12. The apparatus of claim 11, wherein an outermost portion of the outwardly facing rounded-V profile of each of the plurality of first corrugating rollers is positioned within the inwardly facing slot of the corresponding one of the plurality of second corrugating rollers.

13. The apparatus of claim 12, wherein each of the plurality of first corrugating rollers is formed from a material having a hardness of about 80 shore.

14. The apparatus of claim 13, wherein the material is nitrile rubber.

15. The apparatus of claim 12, wherein each of the plurality of second corrugating rollers is formed from a material having a hardness of about 80 shore.

16. The apparatus of claim 15, wherein the material is nitrile rubber.

17. The apparatus of claim 11, wherein an outermost portion of the outwardly facing rounded-V profile of each of the plurality of first corrugating rollers is positioned within the inwardly facing slot of the corresponding one of the plurality of second corrugating rollers without each of the plurality of first corrugating rollers contacting the corresponding one of the plurality of second corrugating rollers.

* * * * *